US005189951A

United States Patent [19]

Webster et al.

[11] Patent Number: 5,189,951

[45] Date of Patent: Mar. 2, 1993

[54] PLANAR SUPPORT FOR MATERIAL MOUNTED TO A FRAME AND METHOD OF USE

[75] Inventors: Ronald B. Webster, Ellington; David P. Boisvert, Bristol; Thomas A. Gordon, Hebron; Michael Baron, Vernon; Michael L. Raczkowski, Tolland; Raymond J. MacQueen, Jr., Canton; Robert Evans, Middletown, all of Conn.; K. Scott Smith, Sturbridge, Mass.

[73] Assignee: Gerber Scientific Products, Manchester, Conn.

[21] Appl. No.: 803,126

[22] Filed: Dec. 4, 1991

[51] Int. Cl.[5] ..... B41C 1/14

[52] U.S. Cl. ..... 101/128.1; 101/128.21; 248/694

[58] Field of Search ..... 101/127.1, 128.1, 128.21, 101/128.4; 248/694

[56] References Cited

U.S. PATENT DOCUMENTS

| | | | |
|---|---|---|---|
| 1,163,647 | 12/1915 | Dick | 101/127.1 |
| 3,280,731 | 10/1966 | Proskaver | 101/127.1 |
| 3,414,994 | 12/1968 | Jaccard et al. | 101/127.1 X |
| 4,442,772 | 4/1984 | Bubley | 101/127.1 |
| 4,967,655 | 11/1990 | Holderegger et al. | 101/128.1 |

*Primary Examiner*—Clifford D. Crowder
*Attorney, Agent, or Firm*—McCormick, Paulding & Huber

[57] ABSTRACT

A sheet material support system includes a floating box having upwardly extending leading edges defining a plane extending parallel to said base in which sheet material is caused to conform to by applying downward pressure to it and causing the sheet material to become tautly drawn over the box upper edges. The system includes a locating block and clamps which allow frames to be located uniformly along X and Y coordinate axes so that successive frames can be loaded in uniform registration in the system.

22 Claims, 6 Drawing Sheets

PLANAR SUPPORT FOR MATERIAL MOUNTED TO A FRAME AND METHOD OF USE

CROSS REFERENCE TO RELATED APPLICATIONS

This application relates to co-pending U.S. Application Ser. No. 07/628,620, now U.S. Pat. No. 5,156,089, entitled PRINTING SCREEN AND METHOD AND APPARATUS FOR ITS MANUFACTURE, filed in the name of McCue et al. on Dec. 17, 1990, which application being assigned to Gerber Scientific Products, Inc. and being commonly assigned with the assignee of the present invention.

BACKGROUND OF THE INVENTION

The present invention resides in a system for supporting a layer of material in a given plane and deals more particularly with a material hold down and support system for use in an apparatus wherein an image is automatically drawn on a surface in a silk screen printing process in which apparatus is provided a means for supporting a printing surface of the screen in a given plane. In the creation of images in a silk screen printing process an emulsion is formed on the screen so that a desired resist is created to provide a backdrop upon which an image can be formed. Recently, as disclosed in the aforesaid U.S. Pat. No. 5,156,089 entitled PRINTING SCREEN AND METHOD AND APPARATUS FOR ITS MANUFACTURE, it has been contemplated to use a single apparatus for generating a plurality of masks each setting out a pattern piece or pieces of the design to be printed in a designated color. This is done by passing a print head over the emulsion to print directly on it and ultimately cause a negative image to be developed in the emulsion. Subsequently, the developed emulsion is used to print the image onto an article. However, in such a system the emulsion is spaced only about 40 thousandths of an inch below the print head during a plotting operation and therefore it is extremely important to maintain this spaced relationship in order to avoid damaging or impairing the plotting operation that occurs during this process. Also, in the silk screen printing art, often it is found that the screen is stapled to a frame and such fasteners have damaged the print head as well. Further, the frames upon which the screens are mounted are usually warped and this also undesirably contributes to the a nonplanar printing surface presented by the screen.

Accordingly, it is an object of the present invention to provide a low cost highly applicable means whereby a screen upon which an emulsion is held in a planer relationship relative to a print head moveable above it is disposed such that the screen presents a planar printing surface while the frame itself is located out of the path of travel of the print head thus avoiding problems hitherto known in the damage of the print head as it is driven during a printing operation.

It is a further object of the present invention to provide a system whereby a silk screen frame is loaded into a support system in registration with two orthogonally oriented axes such that all frames used are capable of having a common registration point in the machine.

Further objects and advantages of the present invention will become apparent with reference to the following disclosure and the appended claims.

SUMMARY OF THE INVENTION

A system for supporting in a given plane a thin layer of material mounted to a frame includes a base having an accurately disposed upwardly facing surface defining the plane to which the material conforms, a first coordinate axis and a second coordinate axis each of which axes being orthogonally oriented relative to one another and disposed relative to the base. A means referencing the planar dimension of said base provides a planar support for supporting a layer of material above the base in a given plane. The system further includes first clamp means for holding a portion of the mounting frame and being disposed along one of the first and second coordinate axes in registration therewith; and second clamp means for holding the frame and drawing it below the given plane and for causing the layer of material overlain on the support means to conform to the generally planar dimension provided by the support means. Locating means is provided and is fixed relative to the base and associated with the other of the first and second coordinate axes for locating the layer of material in registration therewith. The system ma be used in combination with a coordinate controlled printing head disposed for movement in a plane located above and parallel to the given plane.

The invention further resides in a method of using the system as disclosed above to create a planar surface in material mounted to a frame.

DETAILED DESCRIPTION OF THE PREFERRED EMBODIMENT

Figure 1:
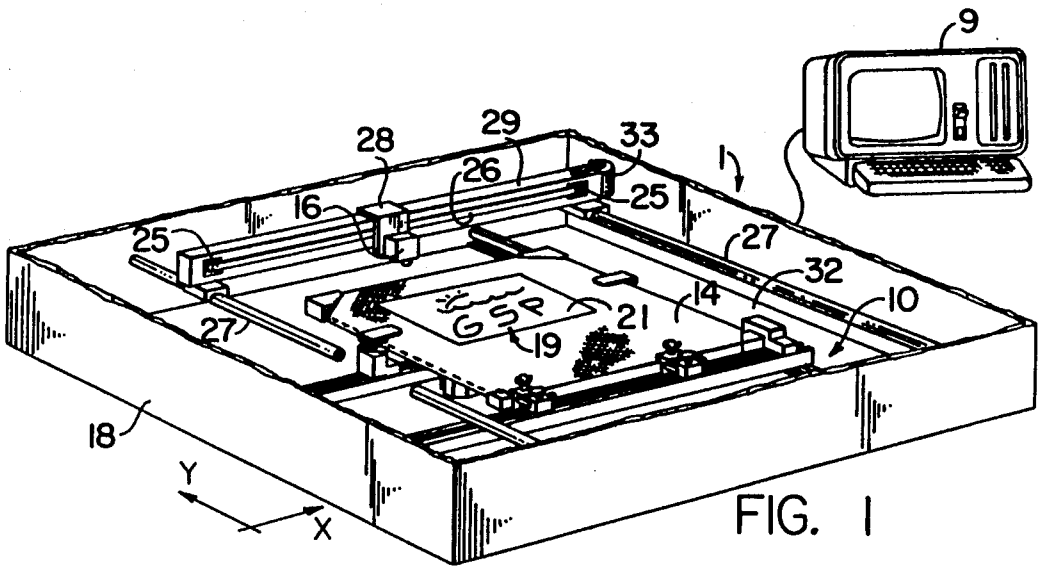
FIG. 1 is a fragmentary perspective view showing the apparatus for automatically making a printing screen by a direct imaging process with its cover removed.

FIG. 1 illustrates an apparatus 1 according to the invention for making a printing screen. The apparatus includes a controller which may be an integral stand alone device or may be a separate computer such as shown at 9, a support assembly 10 which supports a screen 14 within the apparatus 1, and an ink jet printing head 16 which is supported above the screen 14 for movement in a plane generally parallel thereto. The printing head 16 is supported on a pen carriage 28 for movement along the illustrated X and Y-coordinate printing axes. The carriage 28 is slidably mounted on a guide rail 29 which extends across the frame 18 and is in turn slidably mounted at each of its ends for movement along ways 27, 27. An X direction drive motor 34 is driveably connected to the pen carriage 28 by means of a drive belt 26 and pulleys 25,25 to move the carriage in the X-coordinate direction while in the same manner the guide rail 29 is moved in the Y-coordinate direction.

As illustrated in FIG. 1, the apparatus 1 prints an image, such as the graphic 19 directly onto a light-sensitive emulsion layer 21 before exposing it to light. Thereafter, the emulsion is exposed such that those portions of the emulsion that are not covered by ink or other opaque substance harden. A dissolving solution is then applied to the emulsion and the portions of the emulsion which were covered by the opaque material are dissolved. This process is important to the appreciation of the present invention in that it should be understood that several screens are usually used to create a painting on an article surface with each screen being used as a mask through which a given color is deposited. As such, it is highly important that each screen be capable of being held in the apparatus 1 in precisely the same registration as the preceding and following ones thus effecting automatic superposition of the printing material by locating a common reference point.

Figure 2:
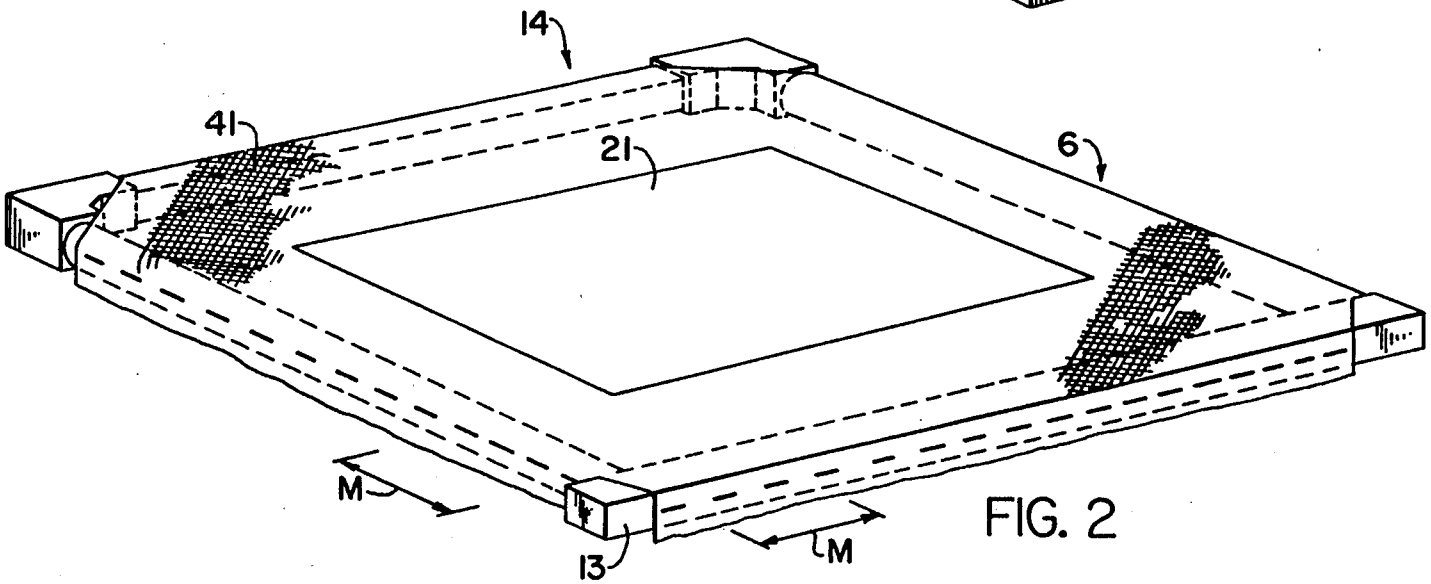
FIG. 2 is a perspective view of a screen used in the apparatus of FIG. 1.
Figure 3:
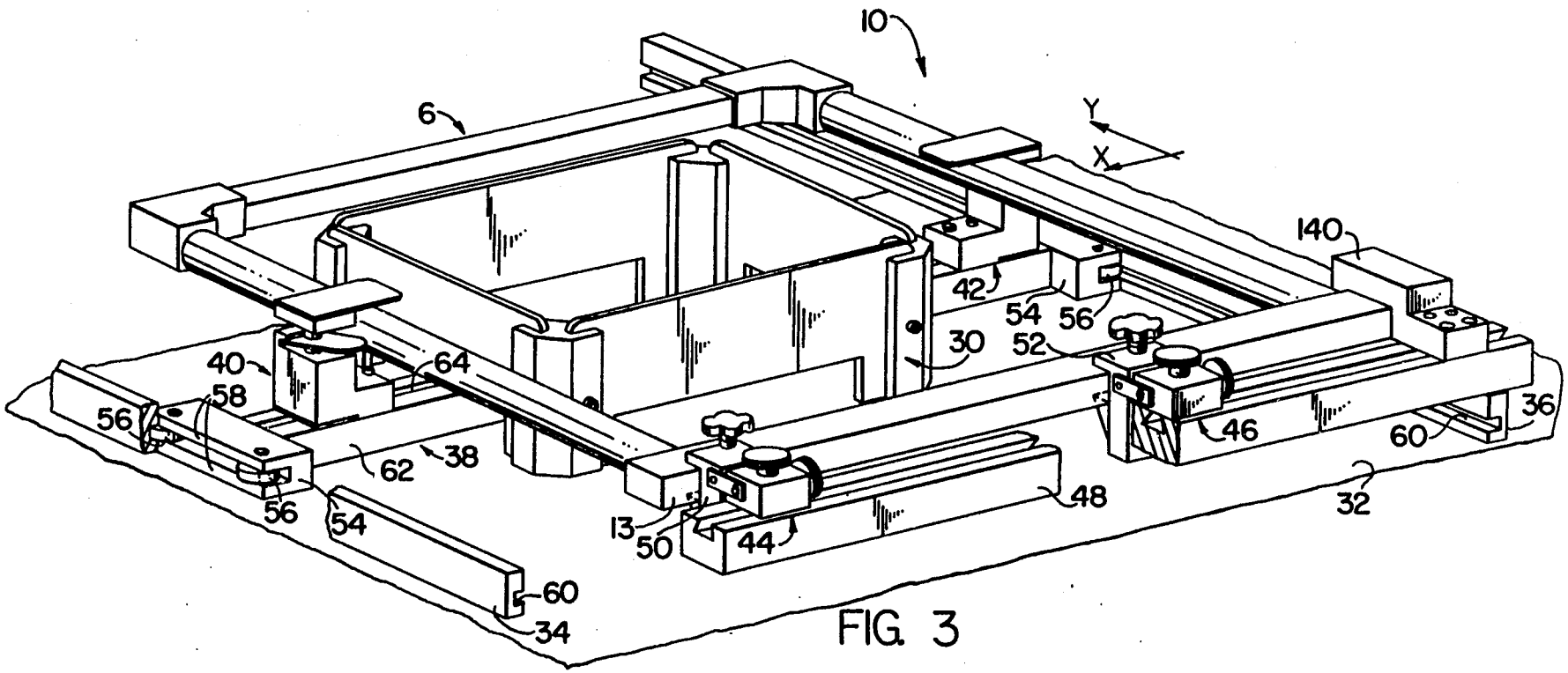
FIG. 3 is a perspective view of the support system employed in the apparatus of FIG. 1.

Referring now to FIG. 2 and to the screen 14, it should be seen that the screen 14 is mounted to a frame 6 and is comprised of a woven fabric 41, generally of polyester or nylon although silk is sometimes still used, stretched tightly over and affixed to a wooden or metal frame 6 to define a printing surface S. The frame 6 may take many different forms, but in the preferred embodiment, it has a leading edge 13 suitably sized and configured to be received within an appropriately sized and shaped holder provided in accordance with the invention. An unexposed light-sensitive emulsion layer 21 is applied to the printing surface S of the screen. The emulsion layer may be applied to the surface S in many different forms, such as, for example, a viscous liquid which is subsequently allowed to dry and harden. For a more complete description of the manner in which the emulsion layer is formed, and other methods of its formation, reference may be had to the aforementioned U.S. Pat. No. 5,156,089, entitled PRINTING SCREEN AND METHOD AND APPARATUS FOR ITS MANUFACTURE. In one mode of practicing the invention, the emulsion layer 21 is preferably formed on the screen 14 such that it leaves exposed a perimeter area collectively defined by margins M,M having, for example, a width equalling about 2 inches. As will hereinafter become apparent, the margins of exposed screen may be used to aid in deflecting the frame below the travel path of the head 16.

The printing head 16 is controllably activated in conjunction with the movement generated by the drive motors in response to the print commands generated and transmitted by the control computer in accordance with data entered into the computer. In this manner, the printing head is translated over the entire surface of the screen to print the graphic 19 directly on the emulsion layer 21 and to precisely and automatically position the graphic with respect to the screen. The printing head 16 is an ink jet printing head, but the apparatus for practicing the invention is in no way limited in this regard. For example, a thermal printing head and an associated thermal printing ribbon may be employed instead. In the case where an ink jet printing head is used to print the graphic on the emulsion layer it has been found particularly advantageous to provide the emulsion layer with an ink receptive material prior to printing the graphic.

In accordance with the invention, the support assembly 10 for supporting the screen 14 includes a floating box 30, a base 32 having a highly accurate planar surface on which the box rests defines the plane ultimately presented to the screen 14, first and second ways 34 and 36 disposed along axes extending parallel to the Y-coordinate direction and spaced from each other generally widthwise of the apparatus 1, and a Y support carriage 38 carrying first and second clamping assemblies 40 and 42 disposed at opposite ends thereof and extending transversely between the first and second ways 34 and 36. The support assembly 10 further includes first and second X-support carriage assemblies 44 and 46 slidably received within a way 48 fixed to the base 32 and disposed in the X coordinate direction and along which each of the first and second X support carriage assemblies is selectively positionable. The first and second Y-coordinate direction ways 34 and 36 extend lengthwise along the base 32 of the apparatus 1, while the X-coordinate direction way 48 extends widthwise thereof to present a work area sufficient to accept different frame sizes which may be used in the creating of a printing screen. The support assembly further includes a locating block 140 which provides a point for registering the frame 6 along the X coordinate direction. This feature taken in conjunction with a similar feature provided in the X-support carriage assemblies 44 and 46 is important as will hereinafter become apparent in that it provides a means by which uniform registration with the apparatus 1 between different screens can be achieved.

The Y-support carriage 38 includes an elongate transverse member 62 connected at its ends to an elongate block 54,54 in which are housed two tracking wheels 56,56 disposed at opposite ends thereof. The tracking wheels 56,56 extend outwardly of the end faces 58,58 of each of the blocks and the member 62 is sized sufficiently lengthwise so as to cause an extending portion of each of the tracking wheels 56,56 to be received within a correspondingly sized and shaped longitudinally extending channel 60,60 which defines each of the ways 34 and 36. The Y-support carriage 38 is thus seated within the ways 34,36 against skewing, yet is capable of moving freely in the illustrated Y coordinate direction.

Figure 4:
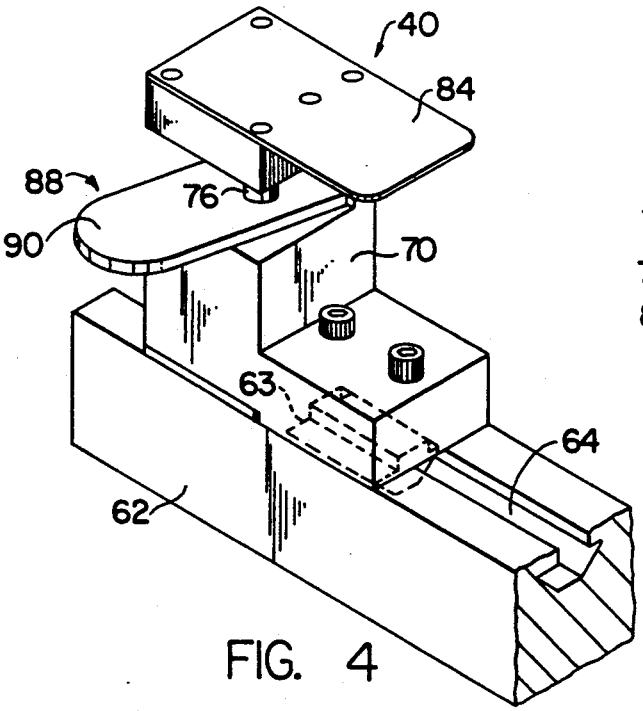
FIG. 4 is a partial fragmentary perspective view of a Y support carriage clamping assembly.
Figure 5:
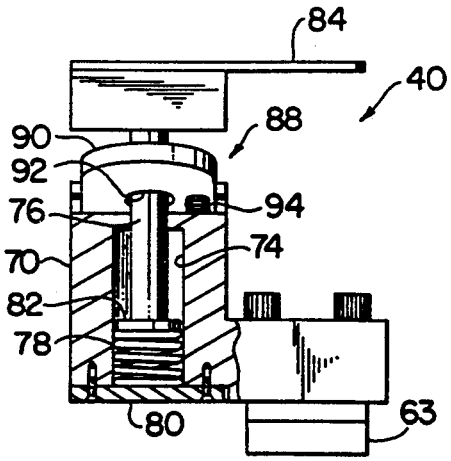
FIG. 5 is a partial fragmentary front elevational view of the assembly of FIG. 4.

Referring now to FIGS. 4 and 5, it should be seen that formed along the upwardly extending face of the transverse member 62 is a T-shaped retaining groove 64 correspondingly sized and shaped to receive a mating portion 63 depending from each of the first and second clamping assemblies 40,42 thereby effecting free sliding movement within the groove 64 yet constraining the assemblies from being moved upwardly. Each of the first and second clamping assemblies 40 and 42 is further comprised of a base or a block portion 70,70, having an opening 74 formed through the top end thereof and being suitably sized for journalling a shaft 76 received therein. The shaft 76 is freely rotatably journalled within the block 70 but is biased upwardly by an internal spring 78 acting between the shaft 76 and a lower plate 80 and has an upper limit stop 82 defining its upper travel limit. At the free end of the shaft 76 is disposed a holding plate 84 cantilevered therefrom to coact with a juxtaposed portion of the frame 6.

For causing the holding plate 84 to be selectively held at a desired height against the upward urging of the internally housed spring 78 and against other forces acting on it as will hereinafter become apparent, the clamping assemblies 40,42 further include a limit mechanism 88 for limiting the upward travel of the shaft 76 above the block portion 70,70. The limit mechanism 88 includes a lever 90 having a slightly oversized opening 92 formed therein, a spring member 94 supported on the base portion 70 and acting against the lever 90. As such, the spring 94 acting in an upward direction against the bottom surface of the lever 90 taken in conjunction with the opening 92 being slightly oversized relative to the shaft diameter, causes a portion of the lever opening 92 to bite on the outer surface of the shaft 76 when the shaft is urged upwardly while nevertheless allowing the holding plates 84,84 to be readily depressed and maintained at a given height depending on where along the path of travel the downward pressure on the shaft 76 is released. This feature provides a means whereby a portion of the frame may be held at a determined position by the mere application of a downward pressing force on the holding plates 84,84 by the user.

Figure 6:
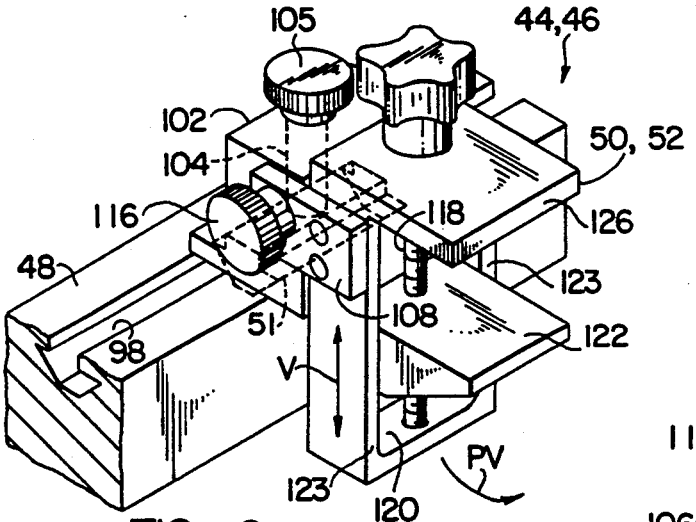
FIG. 6 is a partial fragmentary perspective view of an X carriage clamping assembly.
Figure 7:
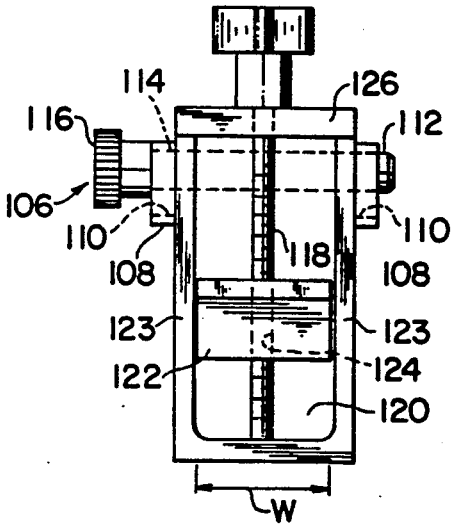
FIG. 7 is a front elevational view of the assembly of FIG. 6.

Each of the first and second X-support carriage assemblies 44,46 shown in detail in FIGS. 6 and 7 includes a block portion 102,102 and an associated clamp 50,52 for engaging with and holding portions of the leading edge 13 of the frame 6 in the manner which will become apparent. The clamp block portions 102,102 are adapted to be freely separately slidable along the way 48 while nevertheless being capable of being locked in a selected position therealong. For this purpose, each of the X support carriage assemblies includes a separate locking part 51,51 inserted within a correspondingly shaped dovetail groove 98 making up the way 48 and being threadably connected to an associated one of the blocks 102,102 through the intermediary of a locking bolt 104 having a turn knob 105 for easy locking of the block portion relative to the way 48.

In addition to being slidingly adjustable along the way 48, each of the clamps 50 and 52 is both vertically and pivotally adjustable relative to its associated block. To this end, a locking means 106 is provided in accordance with the invention and includes two spaced apart plates 108,108 each having vertical slots 110,110 formed therein at ends proximate the block 102, a pin 112 and a threaded shaft 114 each fixed respectively to opposite sides of an associated block and being slidingly received in a respective one of the slots 110,110 formed in each plate pair. The plates are fixed to the clamp 50,52 associated with it and are spaced relative to one another to allow a slight clearance between the inner surfaces thereof and the block 102,102 associated with them thereby allowing a certain play to exist to effect both vertical and pivotal movement. Cooperating with the threaded shaft 114 is a correspondingly threaded knob 116 which upon appropriate turning thereof causes the first and second clamps 50 and 52 to be independently locked relative their respective block portions 102,102 by drawing the inner face of a plate pair into gripping contact with the confronting face of the block portion. Thus, it should be seen that the assemblies 44 and 46 are capable of accommodating any skewing found in a frame shape by allowing adjustments in both the vertical direction indicated by the arrow V and for any needed pivotal movement along the path indicated at PV.

For gripping the leading edge 13 of the frame 6 along a portion of its length, the first and second clamping assemblies 50 and 52 include a cantilevered abutment 126, a moveable jaw 122 cooperative with the abutment and being disposed within a generally rectangular vertically oriented cavity 120 formed within each of the assemblies 50 and 52 actuated by a vertically disposed lead screw 118 journalled at the top and bottom of the clamping assembly. The jaw 122 has a given width dimension W and the cavity 120 is dimensioned widthwise as defined by frontal faces 123,123 so as to be slightly larger than the width dimension W to provide a track along which the jaw 122 slides. A threaded opening 124 is formed in the jaw for receiving the corresponding sized and gauged lead screw 118 such that the jaw 122 is capable of being positively moved in a vertical direction to cause it to clamp a portion of the frame 6 between it and the abutment member 126.

Figure 8B:
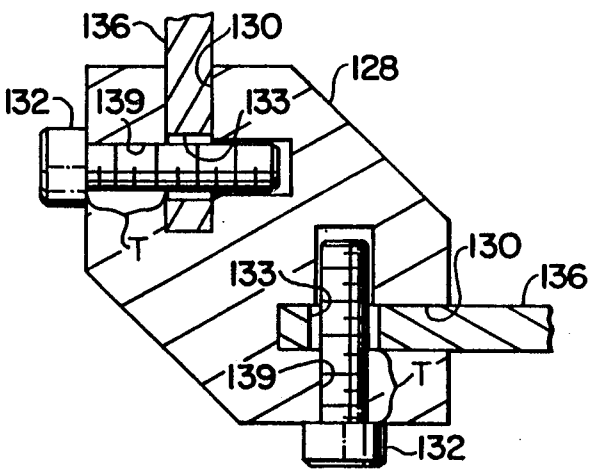
FIG. 8*b* is a partially fragmentary view of a corner connection in the box of FIG. 8*a*.
Figure 8A:
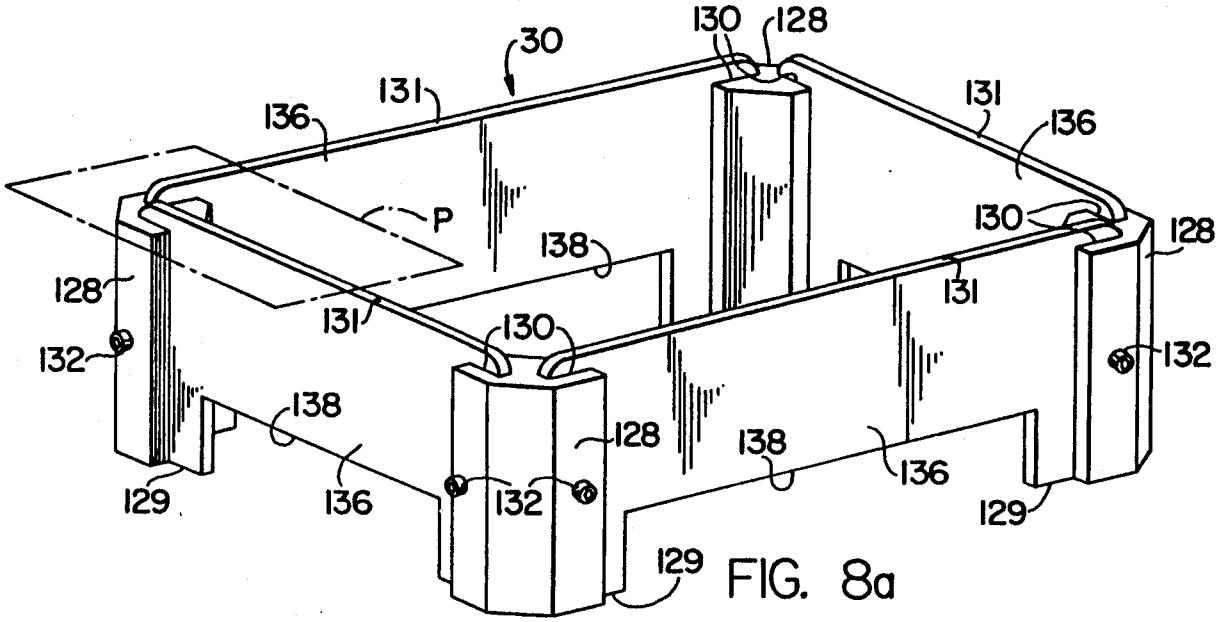
FIG. 8*a* is a perspective view of the floating box support.

Referring now to FIG. 8*a* and in particular to the construction of the floating box 30, it will be seen that the box 30 is comprised of four corners 128,128 having longitudinal recesses 130,130 disposed at 90 degree angles to one another suitable sized and configured to receive one end of the panels 136, 136 which define the box 30. The panels 136,136 are equal heightwise as measured between the footings 129,129 and their upwardly extending edges 131,131. Precise alignment of the edges 131,131 to locate them in a common plane P is effected by the footings 129,129 which are caused to rest on the base 32. In this way, the panels 136,136 are referenced relative to the base 32 and therefore cause the edges 131,131 to lie commonly in plane P. The panels are connected to the corners only to the extent that they create an enclosed shape and such that the corners do not interfere with the even seating of all footings on the base 32. This may be accomplished as shown in FIG. 8*b* by forming openings 139,139 in the corners 128 which communicate with each recess 130,130 and which are threaded only along the outwardly disposed portion T to secure holding screws 132,132 therein. Additionally, generally coincident oversized openings 133,133 are formed in the panels and receive respective ones of the screws 132,132. The panels 136,136 each have a cutout bottom portion 138 which allows the Y-support carriage 38 to extend through the box while nevertheless allowing the box to seat securely on the base 32.

Figure 9:
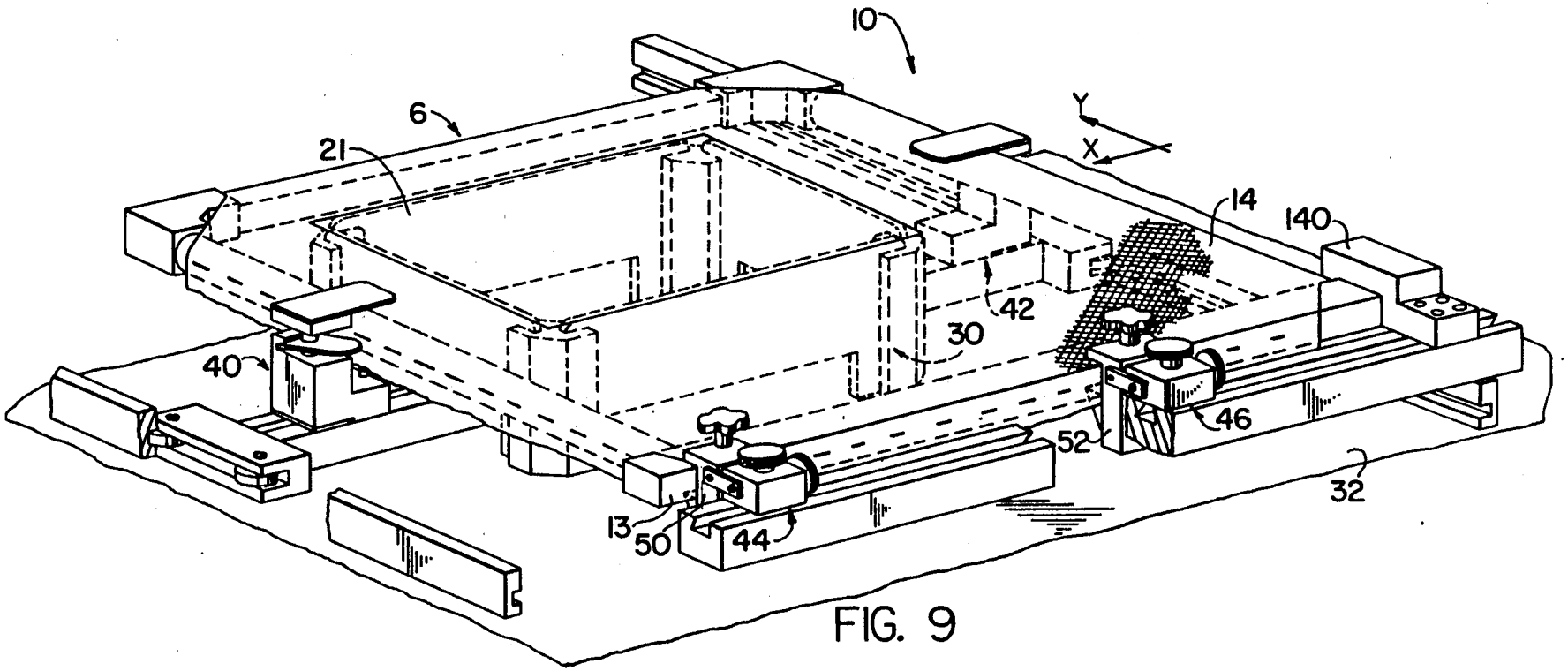
FIG. 9 is a perspective view of the support system of FIG. 3, in this case showing a frame on which is provided an emulsion layer overlay.
Figure 10:
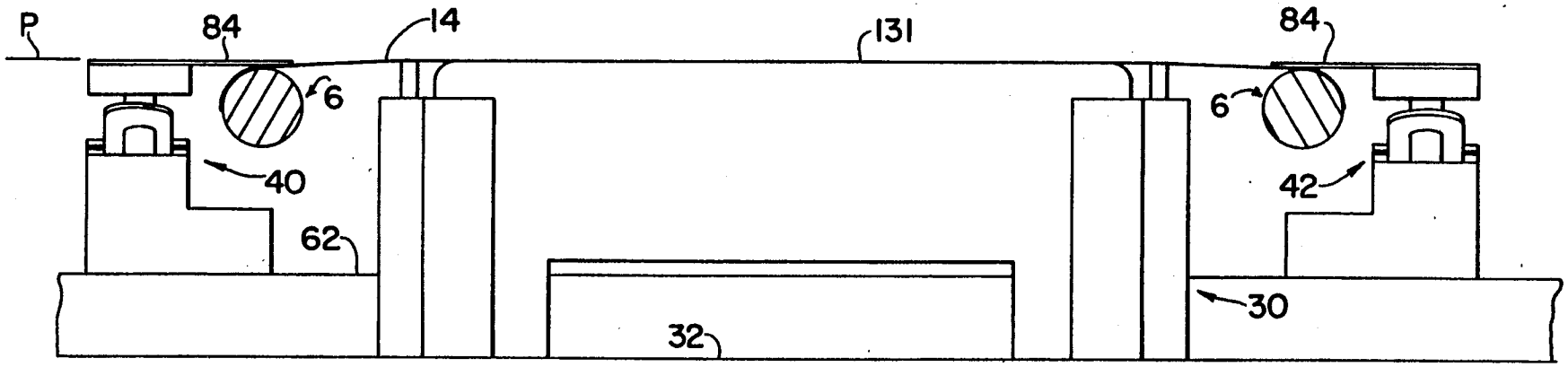
FIG. 10 is a vertical sectional view taken through a screen as it is supported in the system embodying the invention.

In use, as shown in FIGS. 9 and 10, it should be seen that the screen 14 mounted to a frame 6 is initially placed down onto the box 30 such that the area onto which the graphic is to be created is circumscribed by the upwardly extending edges 131,131 of the box 30. In addition, the leading edge 13 of the frame 6 is placed within each of the X-carriage clamping assemblies 50 and 52 in their loosened condition such that this edge abuts the frontal faces 123,123 thereof and that its corner abuts the locating block 140. In this way, uniform registration of any frame can be achieved automatically such that the controller 9 may begin marking a plot relative to the frame edges precisely with reference to the machine axes.

Once the screen 14 is placed flushly within the clamps 50 and 52 it is locked therein and the Y-support carriage clamps 40 and 42 are then moved, and if necessary, swivelled into position along the lateral sides of the frame 6. Subsequently the holding plates 84,84 are depressed slightly drawing the frame below the plane P. It being herein noted that the X-support clamp slots 110,110 are disposed relative to the base 32 so as to generally include the plane P and that it is the downward force caused by the Y support carriage clamps 40 and 42 which is responsible for drawing the screen over the box 30. The screen provides sufficient deflection necessary to allow the frame to be drawn slightly below the plane P in order to force the material to assume the planar orientation set by the upper edges of the box 30.

Once this is done, the user then applies a straight edge over the screen surface to insure that there is nothing which protrudes into the plane P, such as for example a staple or other fastener used to secure the screen. Subsequently, the controller 9 is caused to move the print head over the screen without interference or any obstruction and to create the desired artwork.

From the foregoing a system has been described whereby a material mounted on a frame is caused to assume an orientation in a given plane, but other modifications and substitutions may be had without departing from the spirit of the invention. For example, while the system disclosed herein contemplates use in an apparatus wherein a marking head prints directly onto an emulsion layer formed on the screen, it is nevertheless well within the purview of the invention to use the system in a process in which no emulsion layer is used on the screen. Also, it is disclosed that downward force is applied to the frame by the Y-support carriage clamps 40 and 42, but this force may alternatively be provided by an appropriate carriage along the frame edge which opposes the leading edge 13.

Accordingly, the invention has been described by way of illustration rather than limitation.

We claim:

1. A system for supporting in a given plane fixed relative to a base a thin layer of material mounted to a frame, said system comprising:

a base;

said base having an upwardly facing surface defining the plane to which a material is to assume, said base having disposed thereon a first coordinate axis and a second coordinate axis, each of which axes is orthogonally oriented relative to the other;

support means for referencing the planar dimension of said base and for supporting a layer of material above said base and in a spatial relationship relative to said base upwardly facing surface so as to dispose the layer of material in a given plane parallel to that defined by said upper surface of said base;

first clamp means for holding a portion of said frame to said base with reference to one of the first and second coordinate axes; and second clamp means for holding the frame and drawing it below said given plane and for causing said layer of material overlaid on said support means to conform to said generally planar dimension provided by said support means; and locating means fixed relative to said base and associated with the other of said first and second coordinate axes for locating said frame in registration with reference to the other of said first and second coordinate axes.

2. A system as defined in claim 1 further characterized in that said first clamp means includes means providing both vertical and pivotal movement relative to said one coordinate axis.

3. A system as defined in claim 2 further characterized in that said first clamp means is comprised of two separate clamping assemblies each slidably received within a first way coextensive with one of said coordinate axes.

4. A system as defined in claim 3 further characterized in that each of said two clamping assemblies is comprised of two clamping parts one of which parts is slidably lockable relative to said first way and said second part having frontal faces for causing said frame mounted said material to abut against and be held in registration along said first coordinate axis.

5. A system as defined in claim 4 further characterized in that said support means includes a floating box resting on said base and underlying said material to be worked on.

6. A system as defined in claim 5 further characterized in that said second clamp means is comprised of at least two clamp assemblies one of which assemblies is associated with said other of said two orthogonally oriented coordinate axes.

7. A system as defined in claim 6 further characterized by each of said assemblies of second clamping means being slidably disposed along a support carriage moveable in a direction parallel to said other of said first and second orthogonally disposed coordinate axes.

8. A system as defined in claim 7 further characterized in that said support carriage includes a transverse member extending parallel to the one of said first and second coordinate axes and includes a means for providing a way along which each of said second clamping assemblies slide.

9. A system as defined in claim 8 further characterized in that each of said assemblies of said second clamping means includes a holding plate cantilevered outwardly therefrom; and each of said holding plates being associated with a vertical adjustment locking means for holding said plate at a height above said base.

10. A system as defined in claim 9 further characterized in that said floating box has upwardly extending edges disposed in a common plane with one another and defining said plane in which said material is to be conformed said common plane being referenced to the upwardly facing planar surface of said base; and each of said holding plates comprising said second clamp assemblies being moveably supported intermediate the base and said common plane such that said holding plates are capable of being depressed and held at locations below said plane.

11. A system as defined in claim 10 further characterized in that said transverse member comprising said support carriage is connected at opposite ends thereof to block members having tracking wheels disposed therein and cooperating with first and second ways disposed above said base for positioning said second clamping means assemblies at locations disposed transversely to said one of said first and second orthogonally oriented axes.

12. A system as defined in claim 11 further characterized in that said locating means is a block having a surface extending parallel with said other of said first and second coordinate axes.

13. A system as defined in claim 12 further characterized in that said box is comprised of corner joints having grooves formed therein for receiving corespondingly sized side panels;

each of said side panels comprising said box having a cutout formed along its bottom for allowing aid transverse member of said support carriage to extend transversely across said base when said box is supported thereon.

14. A system as defined in claim 2 further characterized in that said layer of material is a limp screen material mounted tautly to a frame;

said material having a mesh-like quality onto which an emulsion is applied and allowed to harden; and wherein said emulsion is applied to said the mesh-like material such that portions of aid material are left exposed along margins such that when said second clamping means applies a downward pressure to said frame the deflection of said mesh like material occurs in the area delimited by said margins.

15. A system as defined in claim 14 further characterized in that said box has dimensions taken relative to said first and second orthogonally disposed coordinate axes so as to generally underlie said emulsion formed on said mesh-like material.

16. A system as defined in claim 5 further characterized in that said box is comprised of a plurality of panels having footings and connecting corners so assembled that the corners do not interfere with the even seating on the base of all of said footings associated with each panel.

17. A method of forming a planar surface in a sheet of material comprising:

providing a base having a support surface reference a plane to which material is to conform;

providing a support means for defining a plane reference to said base support surface and oriented above said base;

providing said sheet material such that it is mounted on a frame having one edge and another edge;

positioning said material above said support means and orienting said material in registry with a first and a second coordinate axis;

drawing said material over said support means by pulling said material at said edges tautly over said support means thereby causing the material to be conformed coincidentally with said plane defined by said support means; and holding one edge of said frame along said first coordinate axis and holding the other edge of the frame generally orthogonally disposed thereto to said second orthogonal axis and subsequently performing said drawing step by drawing said frame down on said support means at least one point disposed along or parallel to said second orthogonally oriented axis.

18. A method as defined in claim 17 further characterized by providing said support means as a box member having four sides with upwardly extending edges commonly disposed in a single plane; and applying pressure along points of said frame outwardly disposed of said box and spaced therefrom by marginal edge portions.

19. A method as defined in claim 18 further characterized by providing said sheet material as a mesh screen like material and applying an emulsion to said screen-like material such that said marginal edge portions are defined by portions thereon on which said emulsions do not exist.

20. A method as defined in claim 19 further characterized by providing holding members along one of said first and second coordinate axes capable of both vertical and pivotal movement therealong; and drawing said material tautly down over said support means by applying pressure at points located outwardly of said box.

21. In combination with a plotting apparatus having a marking implement moveable in a plotting plane, a system for supporting in a given plane fixed relative to a base parallel to said plotting plane a thin layer of material mounted to a frame, said system comprising:

a base;

said base having an upwardly facing surface defining the given plane to which a material is to assume, said base having disposed thereon a first coordinate axis and a second coordinate axis, each of which axes is orthogonally oriented relative to the other;

support means for referencing the planar dimension of said upwardly facing surface of said base and for supporting a layer of material above said base in a given plane parallel to that defined by said upper surface of said base;

first clamp means for holding a portion of said frame to said base with reference to one of the first and second coordinate axis; and second clamp means for holding the frame and drawing it below said given plane and for causing said layer of material overlaid on said support means to conform to said generally planar dimension provided by said support means; and locating means fixed relative to said base and associated with the other of said first and second coordinate axes for locating said frame in registration with reference to the other of said first and second coordinate axes.

22. The combination as set forth in claim 21 further characterized in that said support means is comprised of a box having a plurality of panels and connecting corners so assembled such that the corners do not interfere with the even seating of all footings associated with each panel on the base.

* * * * *

UNITED STATES PATENT AND TRADEMARK OFFICE

CERTIFICATE OF CORRECTION

PATENT NO. : 5,189,951

DATED : March 2, 1993

INVENTOR(S) : Ronald B. Webster et al

It is certified that error appears in the above-identified patent and that said Letters Patent is hereby corrected as shown below:

Column 8

Line 11, delete "mounted" and substitute--mounting--.

Line 45, after "formed" insert--,--.

Column 9

Line 2, delete "aid" and substitute--said--.

Line 12, delete "aid" and substitute--said--.

Line 30, delete "reference" and substitute--referencing--.

Lines 32 and 33, delete "reference" and substitute--referenced--.

Line 50, between "means" and "at" insert--at--.

Signed and Sealed this

Twenty-sixth Day of April, 1994

*Attest:*

Bruce Lehman

BRUCE LEHMAN

*Attesting Officer*

*Commissioner of Patents and Trademarks*